US009631347B1

(12) United States Patent
Kuhn

(10) Patent No.: US 9,631,347 B1
(45) Date of Patent: Apr. 25, 2017

(54) SYSTEM AND METHOD FOR STABILIZING CHLORINE RESIDUAL IN A DEAD END WATER MAIN

(71) Applicant: Mell H. Kuhn, Arkansas City, KS (US)

(72) Inventor: Mell H. Kuhn, Arkansas City, KS (US)

( * ) Notice: Subject to any disclaimer, the term of this patent is extended or adjusted under 35 U.S.C. 154(b) by 0 days.

(21) Appl. No.: 15/250,200

(22) Filed: Aug. 29, 2016

(51) Int. Cl.
*E03B 7/02* (2006.01)
*E03B 7/09* (2006.01)
*E03B 7/07* (2006.01)

(52) U.S. Cl.
CPC ..... *E03B 7/02* (2013.01); *E03B 7/074* (2013.01); *E03B 7/09* (2013.01)

(58) Field of Classification Search
CPC ..... E03B 7/02; E03B 7/04; E03B 7/09; Y10T 137/86083; Y10T 137/85978; Y10T 137/85954
USPC ..... 137/563, 565.01, 565.23
See application file for complete search history.

(56) References Cited

U.S. PATENT DOCUMENTS 3,509,909 A * 5/1970 Douglas ..... F16K 5/04 137/565.23
4,111,224 A * 9/1978 Sandstrom ..... E03B 7/04 137/207
4,881,567 A * 11/1989 Rockower ..... F16L 55/09 137/203
5,535,770 A * 7/1996 Nurmi ..... E03F 1/006 137/14
5,921,270 A 7/1999 McCarty
6,062,259 A 5/2000 Poirier
6,635,172 B2 10/2003 Newman
6,705,344 B2 * 3/2004 Poirier ..... E03B 7/04 137/561 A
6,779,539 B1 * 8/2004 Schwamberger ..... C02F 1/688 137/1
6,880,566 B2 4/2005 Newman
6,948,512 B2 9/2005 McKeague
8,733,390 B2 5/2014 McKeague
2004/0094208 A1 * 5/2004 Marsden ..... A01C 23/042 137/564.5
2011/0083761 A1 * 4/2011 Evans ..... A01G 27/005 137/565.01
2011/0297240 A1 * 12/2011 Fanelli ..... A61M 3/0279 137/14
2012/0132238 A1 * 5/2012 Hallundbæk ..... B08B 9/049 134/169 C

* cited by examiner

*Primary Examiner* — Craig Schneider
*Assistant Examiner* — Nicole Wentlandt
(74) *Attorney, Agent, or Firm* — George L Williamson

(57) ABSTRACT

System and method for automatically and remotely maintaining acceptable levels of chlorine residual in the dead end branches of potable water mains so as to protect the users from high levels of coliform organisms by pumping stagnant water from the dead end branch back to a flowing water main. A solar panel serves as the source of power with batteries being used to store energy. A water circulation pump evacuates water through an insertable rigid flexible tubing from a point near the distal end of the dead end branch to the nearest flowing water main. A programmable logic controller is used to operate the pump during periods of time when there is enough available solar energy or when the batteries are sufficiently charged.

20 Claims, 3 Drawing Sheets

SYSTEM AND METHOD FOR STABILIZING CHLORINE RESIDUAL IN A DEAD END WATER MAIN

BACKGROUND OF THE INVENTION

Field of the Invention

The present invention relates generally to appurtenances for potable water supply systems and, more particularly, is concerned with a dead end potable water main chlorine residual stabilization system.

Description of the Related Art

Devices relevant to the present invention have been described in the related art, however, none of the related art devices disclose the unique features of the present invention.

In U.S. Pat. No. 6,062,259 dated May 16, 2000, Poirier disclosed a method and apparatus for preventing water from stagnating in branches of a municipal water supply system, however, Poirier is different from the present invention in that, as a minimum, it has no solar panel for supplying energy and no computer for controlling the pump. In U.S. Pat. No. 5,921,270 dated Jul. 13, 1999, McCarty disclosed an automatic flush system for water lines. In U.S. Pat. No. 6,635,172 dated Oct. 21, 2003, Newman disclosed an apparatus for the enhancement of water quality in a subterranean pressurized water distribution system. In U.S. Pat. No. 6,880,566, dated Apr. 19, 2005, Newman disclosed an apparatus for the enhancement of water quality in a subterranean pressurized water distribution system. In U.S. Pat. No. 6,948,512 dated Sep. 27, 2005, McKeague disclosed a flushing attachment for a hydrant. In U.S. Pat. No. 8,733,390 dated May 27, 2014, McKeague disclosed an automatic flushing device for municipal water systems.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an environmentally friendly system for automatically and remotely maintaining legally required healthy and acceptable levels of chlorine residual in the dead end branches of potable water mains so as to protect the users from high levels of coliform organisms by recirculation of the stagnant dead end water back to a flowing water main. A pump circulates stagnant water from near the end of the dead end water main back through a tube to a water main having flowing water therein. Thus, stagnant water is evacuated from the problematic dead end branch of the water main back to the flowing water main which, due to fluid dynamics, causes fresh water from the flowing water main to replace the stagnant water as fresh water is circulated back to the area of the dead end water main. The present invention uses a remote photovoltaic solar array mounted on a stanchion as its source of power which is electrically connected to a watertight vault housing a lithium ion battery pack, programmable logic controller (PLC), pump, power cables, flow meter, and test port all designed for being accessible from the surface of the ground for service and/or repair. The pump assembly is controlled by a PLC control panel set to send power from the solar array to the battery pack for recharge, wherein the battery level triggers/actuates the PLC controller to sequence the timer to power the pump which is on a variable timed schedule determined by the dead end pipe size, length and ambient conditions so as to maintain the proper level of chlorine residual.

An object of the present invention is to prevent water in dead end branch water mains from becoming stagnant due to depletion of the residual chlorine caused by dissipation or chloramines decay. A further object of the present invention is to circulate water from a dead end branch water main back to a flowing water main so that the water is refreshed with high chlorine residual water from the flowing water main. A further object of the present invention is to provide a system which can be used to retrofit existing water supply systems having dead end branch water mains commonly found in municipal and rural water supply/distribution systems. A further object of the present invention is to provide a system which is self-contained and can be successfully operated without access to the public power grid wherein the system receives its only source of required energy from a photovoltaic solar panel. A further object of the present invention is to provide a system which can be easily installed requiring only minimal training to a utility operator or contractor. A further object of the present invention is to provide a system which can be easily operated by a user. A further object of the present invention is to provide a system which can be relatively inexpensively operated and maintained.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
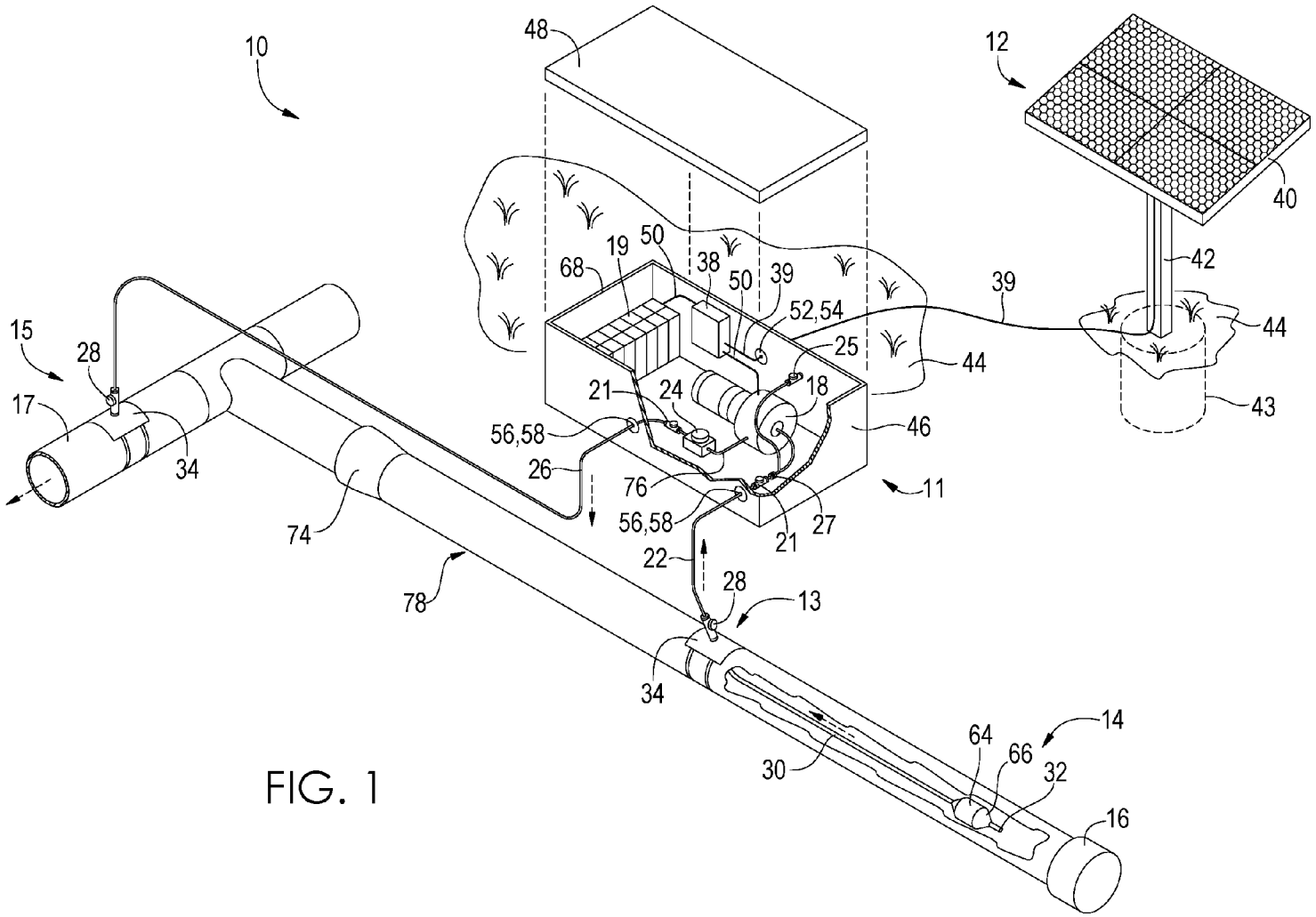
FIG. 1 is a perspective view of the present invention.

With regard to reference numerals used, the following numbering is used throughout the drawings.

10 present invention
11 pump assembly
12 power assembly
13 tube insertion assembly
14 suction end assembly
15 connection assembly to flowing main
16 dead end
17 flowing main
18 circulation pump
19 lithium ion battery pack
21 pump isolation valve

22 pump inlet line
24 flow meter
25 sampling valve with vacuum breaker
26 pump discharge line
27 pump check valve
28 insertion/isolation valve
30 rigid flexible insert tubing
32 inlet of insert pipe
34 tapping saddle
38 control panel/programmable logic controller
39 power cable
40 photovoltaic solar panel
42 stanchion
43 concrete pier with mounting plate
44 ground
46 vault
48 bolt down cover with gasket seal
50 electrical connection
52 aperture
54 water tight electrical plug and bulkhead socket
56 aperture
58 water tight bulkhead fitting
64 insert/pulling cone
66 sloping head
68 wall of vault
70 tapping sleeve
71 access cover
72 45 degree lateral pipe with flanged end
74 joint
76 pump discharge line
78 dead end main

DETAILED DESCRIPTION OF THE PREFERRED EMBODIMENT

Figure 2:
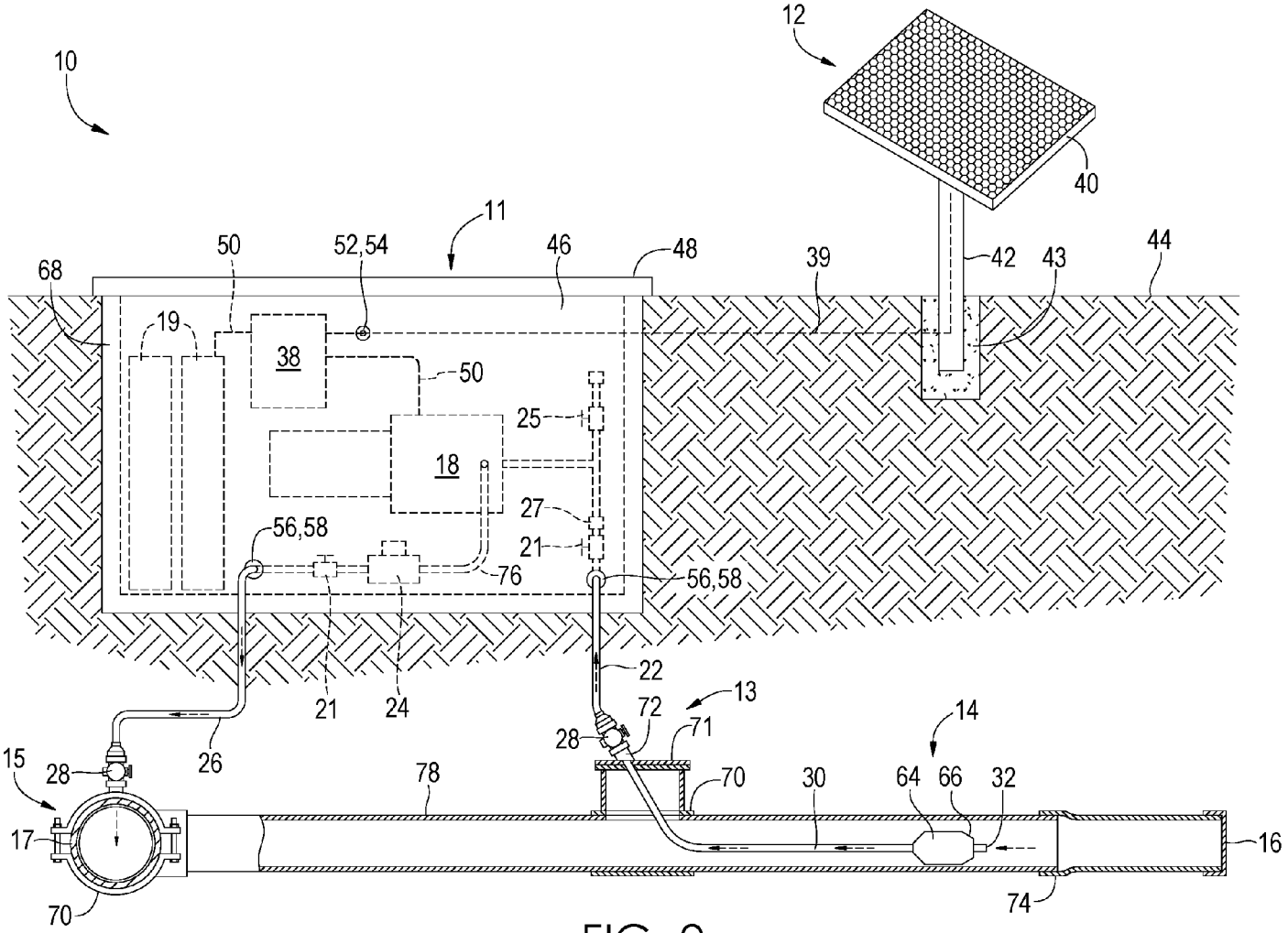
FIG. 2 is a side elevation view of the present invention.
Figure 3:
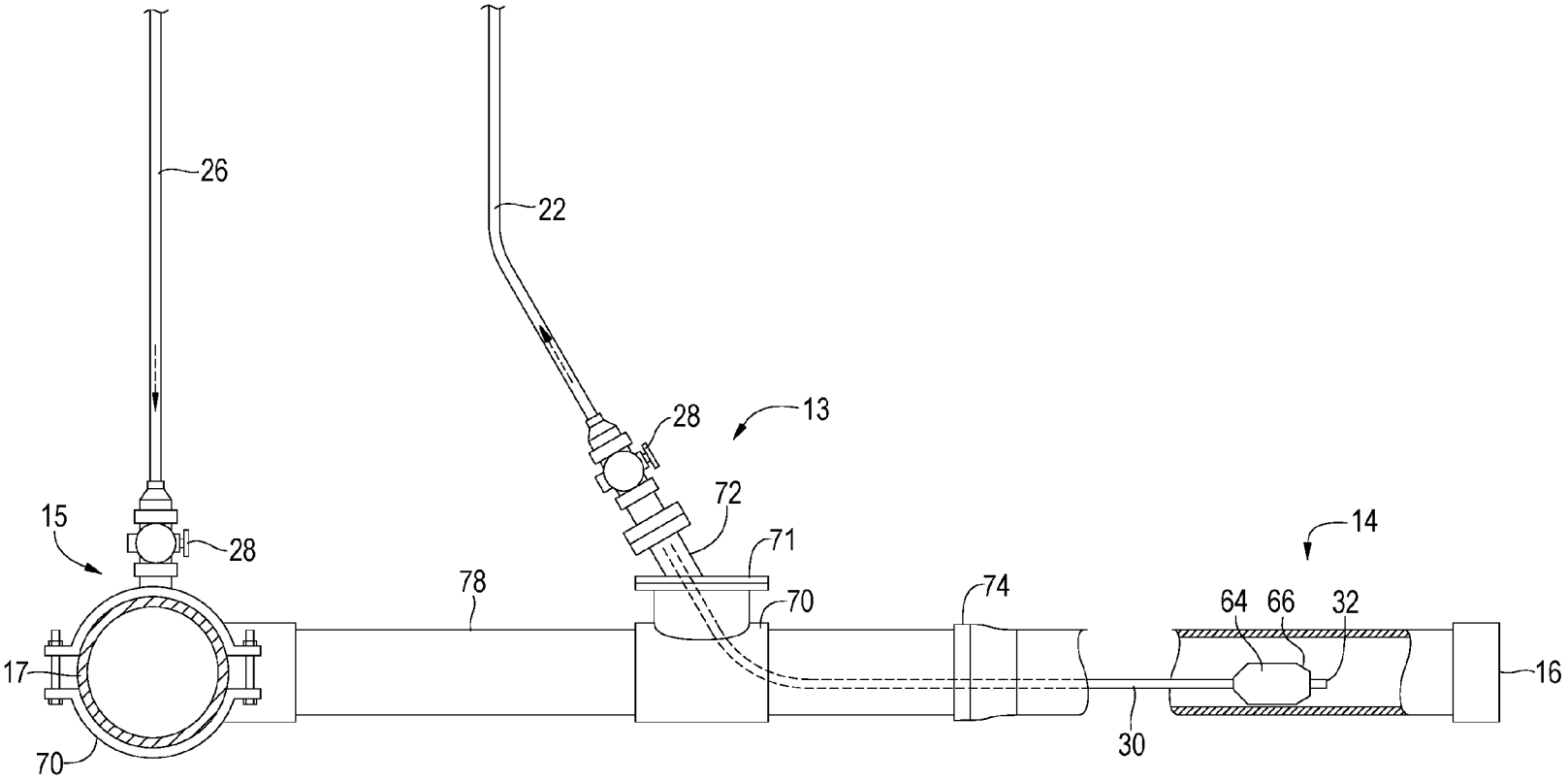
FIG. 3 is a side elevation view of portions of the present invention.

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 3 illustrate the present invention which disclosed a method and apparatus for automatically stabilizing the residual chlorine level of water mains containing potable water and which is generally indicated by reference number 10.

Turning to FIGS. 1 and 2, therein is shown the present invention 10 wherein a dead end branch water main 78 has its water refreshed from a flowing water main 17 by evacuating by pumping the stagnated water from near the dead end 16 by drawing the water through the inserted rigid flexible insert tube 30 which is connected to the suction side of pump 18 of pump assembly generally indicated by reference number 11 by means of pump inlet line 22. The water is then pumped through and then out pump discharge line 26 into the water main connection assembly generally indicated by reference number 15 which is attached to the flowing main 17 thereby causing the replacement of the stagnated water associated with the dead end 16 area of the dead end branch water main 78 with the higher chlorine residual water from the flowing water main 17.

FIG. 1 shows one embodiment of a connection assembly 15 having an insertion/isolation valve 28 mounted onto a saddle-type connector or tapping saddle 34 for connection to flowing water main 17. FIG. 2 shows a second embodiment of a connection assembly 15 having the insertion/isolation valve 28 attached to or bolted to a sleeve-type connector being a stainless steel or like tapping sleeve 70 for connection to flowing water main 17.

Suction end assembly generally indicated by reference number 14 is attached to the distal end of the rigid flexible insert tubing 30 which is inserted through the dead end main 78 having an inlet 32 on its distal end. The suction end assembly 14 includes an insert/pulling cone 64 attached near the distal end of insert tubing 30. The insert/pulling cone 64 has a sloping head or face 66 thereon so that the insert/pulling cone can be slidably inserted through the dead end water main 78 without hanging up or catching on any build up, edge or seam as might occur, e.g., at a joint 74 as a result of joining together pipe sections of the dead end water main. The purpose of the sloping head 66 is to allow the insert/pulling cone 64 to easily pass through the interior of the dead end branch water main 78.

Tube insertion assembly generally indicated by reference number 13 enables the rigid flexible insert tubing 30 to be inserted into the dead end main 78 and be isolated for service and testing without valving off or otherwise isolating the dead end main 78. FIG. 1 shows one embodiment of a tube insertion assembly 13 having an insertion/isolation valve 28 mounted onto a saddle-type connector or tapping saddle 34 so that the valve 28 is angled with respect to the dead end main 78. FIG. 2 shows another embodiment of a tube insertion assembly 13 having the insertion/isolation valve 28 attached to a 45 degree flanged lateral pipe 72 which is attached to a sleeve-type connector being a stainless steel or like tapping sleeve 70 interconnecting the dead end branch main 78 to the pump assembly 11. Access cover 71 is also provided on tapping sleeve 70. FIG. 3 shows a more detailed view of the tube insertion assembly 13 and connection assembly 15.

Pump assembly 11 connects to tube insertion assembly 13 via pump inlet line 22 passing through vault wall 68 through aperture 56 sealed from ground water with water tight bulkhead fitting 58 and then to isolation valve 21. A pump check valve 27 is connected to the suction side of pump 18 which pump then discharges through pump discharge line 76 to flow meter 24 and then through a second pump isolation valve 21 and then the pump discharge is piped through vault wall 68 using aperture 56 and sealed from ground water by bulkhead fitting 58. A sampling valve with vacuum breaker 25 is also provided. Pump 18 is controlled by the computer in the PLC control panel 38 and powered by lithium ion battery pack 19 which receives electrical power from power cable 39 passing through vault wall 68 using aperture 52 and seal 54. Power cable 39 is connected to power assembly 12. Vault 46 is expected to be water tight having a bolt-down cover with gasket seal 48 thereon which is expected to be accessible from above ground 44.

Systems power is supplied by power assembly generally indicated by reference number 12 including solar panel 40 serving as the power source disposed on a stanchion 42 and mounted into the ground 44 using a concrete pier with mounting plate 43. The electrical cable 39 attaches to and passes through the wall 68 of vault 46 via aperture 52 and water tight plug 54. Miscellaneous electrical 50 connects control panel 38 to the battery pack 19 and pump 18.

Turning to FIG. 3, shows a more detailed view of the tube insertion assembly 13 and connection assembly 15 as previously disclosed relative to FIGS. 1 and 2. The tapping sleeve inlet 70 is provided for receiving insertion tubing 30 in its interior wherein flanged insert valve 28 and an insertable flexible rigid tube 30 is disposed at an angle of about 30-45 degrees with respect to the centerline of water main 78, the angle being effectively sized to allow for insertion into and retrofitting of an existing underground water supply system so as to ease the installation of tube 30 into water main 78.

The vault 46 and cover 48 are expected to be made of concrete, cement, fiberglass, or the like, the material being suitable for installation in remote areas, as would be done in the standard manner by one skilled in the art.

The present invention 10 is expected to be installed on existing municipal or rural potable water distribution systems. The steps of the installation process are as follows: 1) locate the dead end water main segments 78 of the water system and measure back to the source main 17 to establish the length of insert tube 30; 2) valve off dead end section and excavate the end 16; 3) install tapping sleeve/saddle 34, 70 and insertion valve 28 and tap flowing water main for pump discharge piping 26; 4) install tapping sleeve/saddle 34, 70 to tap dead end water main 78 for circulator tube 30; 5) through the sleeve opening of dead end main 78 insert cone 64 and circulator tube 30 and push to the pre-measured end (note, if the dead end is longer than 200 feet or there is interior pipe corrosion this operation may require using a push rod to assist the insertion and some installations may require a second tapping sleeve installed near the source main and the insert be pulled in via poly rope floated down to the first tapping sleeve at the dead end; 6) install flanged valve 28 and pump inlet pipe 26 and backfill allowing for vault 46; 7) set vault 46 and connect pipes 22, 26 to prospective bulkhead fittings 58 and complete backfill; 8) excavate for stanchion base and pour concrete pier with conduit embedded and stainless steel mounting studs; 9) set stanchion 42 and solar panel 40; 10) trench in power cable and connect to vault plug 54 and solar plug jack at array and charge battery pack; 11) test for chlorine and determine dead-end volume for PLC programming pump controller clock and start system; 12) check meter located in vault to confirm operation and take water sample for testing residual chlorine; 13) in four hours check meter for gallons moved and retest chlorine residual; 14) recheck every 24 hours for the first three days and then weekly thereafter.

To retrofit the present invention 10 to an existing water supply system the insert/pulling cone 64 having its sloped face 66 is crucial because the outlet 32 could snag on the internal joint seams 74 and formations inside the dead end water main 78. Also, the flanged insert valve 28 is attached at about a 30-45 degree angle with respect to the dead end main 78 so as to allow the pump inlet tube 22 and insertable flexible rigid tube 30 to be pushed, pulled, or slidably inserted into the existing underground dead end water main 78 which may be several feet, e.g., 3-6 feet, below the surface of the ground 44.

The present invention 10 is designed for installation and operation in remote areas and is designed to require low maintenance and to have a low operating cost. Therefore, the programmable logic controller 38 is expected to be programmed so as to operate the pump 18 only during periods of time when there is enough available solar energy to do so or when the batteries are sufficiently charged to do so; at other times the pump is expected to be off. It is believed that this operating regimen will allow for the present invention 10 to operate at minimum costs.

I claim:

1. A system for stabilizing the chlorine residual of a dead end water main for use on a potable water supply system having a dead end water main connected to a flowing water main, comprising:

a) a pump for circulating water from the dead and water main to the flowing water main, said circulation pump having an inlet and an outlet;

b) a water inlet line having first and second ends, said first end adapted for connection to said inlet of said circulation pump, said second end adapted for connection to a point on the dead end water main;

c) a water outlet line having first and second ends, said first end adapted for connection to said outlet of said circulation pump and said second end adapted for connection to a point on the flowing water main;

d) an insert tube having first and second ends, said first end adapted for connection to said second end of said water inlet line, said second end configured for slidable insertion into an interior of the dead end water main so that said second and is disposed proximate a dead end of the dead end water main;

e) a solid insert cone with sloping ends at both ends thereof mounted on said insert tube adjacent said second end for permitting said second end to be guided through said tube without hanging up on any build up, edge or seam in said dead end water main as said insert tube is moved through said dead end water main, said insert tube extending into a proximate end of said cone, though said insert cone, and out a distal end of said insert cone, and terminating at a point spaced from said distal end; and, f) a computer for controlling said pump so as to pump water through said insert tube from the dead end water main to the flowing water main to stabilize the chlorine residual in the dead and water main.

2. The system of claim 1, further comprising a sampling valve connected to said water inlet line to said circulation pump for testing residual chlorine in the dead end water main.

3. The system of claim 2, further comprising a solar panel for providing electrical energy to said pump.

4. The system of claim 3, further comprising a battery for providing electrical energy to said pump.

5. The system of claim 4, wherein said computer actuates said pump only when a predetermined minimum amount of electrical energy for operating said pump is available from either said solar panel or said battery and using sample testing of residual chlorine to provide information for programming said computer.

6. The system of claim 5, further comprising a vault for housing said pump, said battery and said computer.

7. The system of claim 6, wherein said vault is underground with a top cover for access by an operator.

8. The system of claim 7, wherein said vault is substantially watertight.

9. The system of claim 8, wherein said insert tube extends into said dead end water main at an angle to facilitate pushing, pulling or sliding of said insert tube in said dead and water main.

10. The system of claim 9, wherein said insert tube is rigidly flexible.

11. A method for stabilizing the chlorine residual of a dead end water main for use on a potable water supply system having a dead and water main connected to a flowing water main, comprising the steps of:

a) pumping water from the dead end water main to the flowing water main, providing a pump having an inlet and an outlet;

b) providing a water inlet line having first and second ends, adapting the first end for connection the inlet of the pump, adapting the second end for connection to a point on the dead end water main;

c) providing a water outlet line having first and second ends, adapting the first end for connection to the outlet of the circulation pump, adapting the second end for connection to a point on the flowing water main;

d) inserting a tube having first and second ends into the dead end water main so that the second end is disposed proximate a dead end of the dead end water main, adapting the first end for connection to the second end of the water inlet line;

e) providing a solid insert cone with sloping ends at both ends thereof mounted on said insert tube adjacent said second end for permitting said second end to be guided through said tube without hanging up on any build up, edge or seam in said dead end water main as said insert tube is moved through said dead end water main, said insert tube extending into a proximate end of said cone, through said cone, and out a distal end of said cone, and terminating at a point spaced from said distal end; and, f) controlling the pump with a computer so as to pump water through the tube from the dead and water main to the flowing water main to stabilize the chlorine residual in the dead end water main.

12. The method of claim 11, further comprising the step of providing a sampling valve connected to said water inlet line to said circulation pump for testing residual chlorine in the dead end water main.

13. The method of claim 12, further comprising the step of providing a solar panel for providing electrical energy to the pump.

14. The method of claim 13, further comprising the step of providing a battery for providing electrical energy to the pump.

15. The method of claim 14, wherein the computer actuates the pump only when a predetermined minimum amount of electrical energy for operating the pump is available from either the solar panel or the battery and using sample testing of residual chlorine to provide information for programming said computer.

16. The method of claim 15, further comprising the step of providing a vault for housing the pump, the battery, and the computer.

17. The method of claim 16, wherein the vault is adapted for being accessible by an operator from above ground.

18. The method of claim 17, wherein the vault is substantially watertight.

19. The method of claim 18, further comprising the step of inserting the tube into the dead end water main at an angle to facilitate pushing, pulling or sliding said insert tube in said dead end water main.

20. The method of claim 19, wherein the tube is rigidly flexible.

* * * * *